US007802848B2

(12) United States Patent
Suprina

(10) Patent No.: US 7,802,848 B2
(45) Date of Patent: Sep. 28, 2010

(54) BLEACHER SEAT

(76) Inventor: Scott Suprina, 26 Parkway Dr. South, Commack, NY (US) 11725

( * ) Notice: Subject to any disclaimer, the term of this patent is extended or adjusted under 35 U.S.C. 154(b) by 625 days.

(21) Appl. No.: 11/263,077

(22) Filed: Oct. 31, 2005

(65) Prior Publication Data

US 2006/0108843 A1 May 25, 2006

Related U.S. Application Data

(63) Continuation-in-part of application No. 10/441,354, filed on May 20, 2003, now abandoned.

(60) Provisional application No. 60/623,832, filed on Oct. 29, 2004, provisional application No. 60/627,523, filed on Nov. 12, 2004.

(51) Int. Cl.
*A47C 15/00* (2006.01)

(52) U.S. Cl. ..... 297/352; 297/230.12; 297/284.5; 297/452.14

(58) Field of Classification Search ..... 297/352, 297/252, 284.5, 230.1, 230.12, 452.3, 452.65, 297/452.14

See application file for complete search history.

(56) References Cited

U.S. PATENT DOCUMENTS

| | | | | |
|---|---|---|---|---|
| 846,904 | A | | 3/1907 | Bady-Gerstenmaier |
| 1,515,564 | A | | 11/1924 | Field |
| 2,449,523 | A | | 9/1948 | Wilson |
| 2,509,420 | A | | 5/1950 | Burch |
| 2,710,646 | A | | 6/1955 | Kirby |
| 2,736,365 | A | | 2/1956 | Hines |
| 2,754,891 | A | | 7/1956 | Barron |
| 2,792,875 | A | | 5/1957 | Pirrone |
| 2,873,792 | A | | 2/1959 | Miralles |
| 3,026,142 | A | | 3/1962 | Holloway |
| 3,066,980 | A | | 12/1962 | Clute |
| D209,960 | S | | 1/1968 | Rogers |
| 3,873,151 | A | | 3/1975 | Morris |
| 4,079,993 | A | | 3/1978 | Pierce |
| D249,217 | S | | 9/1978 | Pierce |
| D252,658 | S | | 8/1979 | Kressin |
| 4,363,197 | A | | 12/1982 | Aurit |
| 4,490,949 | A | | 1/1985 | Sutter |
| 4,565,036 | A | | 1/1986 | Lyman, Jr. |
| 4,611,852 | A | * | 9/1986 | Filer ..... 297/352 |
| 5,042,875 | A | * | 8/1991 | Biggs, Sr. ..... 297/252 X |
| 5,277,001 | A | | 1/1994 | Bryant |
| 5,356,201 | A | | 10/1994 | Olson |
| 5,364,163 | A | | 11/1994 | Hardison |
| 5,407,247 | A | * | 4/1995 | Forcier et al. ..... 297/352 |
| 5,913,776 | A | | 6/1999 | Compagnone |
| 6,502,902 | B1 | | 1/2003 | Romero |
| 6,739,667 | B1 | | 5/2004 | Jones |
| 6,783,184 | B2 | * | 8/2004 | DiBattista et al. ... 297/452.65 X |
| D495,511 | S | | 9/2004 | Dingess |
| D495,514 | S | | 9/2004 | Ricci |
| 6,899,391 | B1 | | 5/2005 | Schneller |
| 6,938,101 | B2 | | 8/2005 | Hayes |
| 7,246,824 | B2 | * | 7/2007 | Hudson ..... 283/91 X |

* cited by examiner

*Primary Examiner*—Anthony D Barfield
(74) *Attorney, Agent, or Firm*—James M Loeffler, Esq.

(57) ABSTRACT

A seat module that forms a seat portion and an upright lumbar and thoracic support portion in one piece as a commercial grade seat that can be retro-fitted to any stadium bleacher easily to conform with building safety codes and provide comfortable seating to the patrons of the stadium.

44 Claims, 8 Drawing Sheets

12"
24"
12"
104
100
103
101
108
100
101
100
101

100
104
103
101
108

FIG. 10
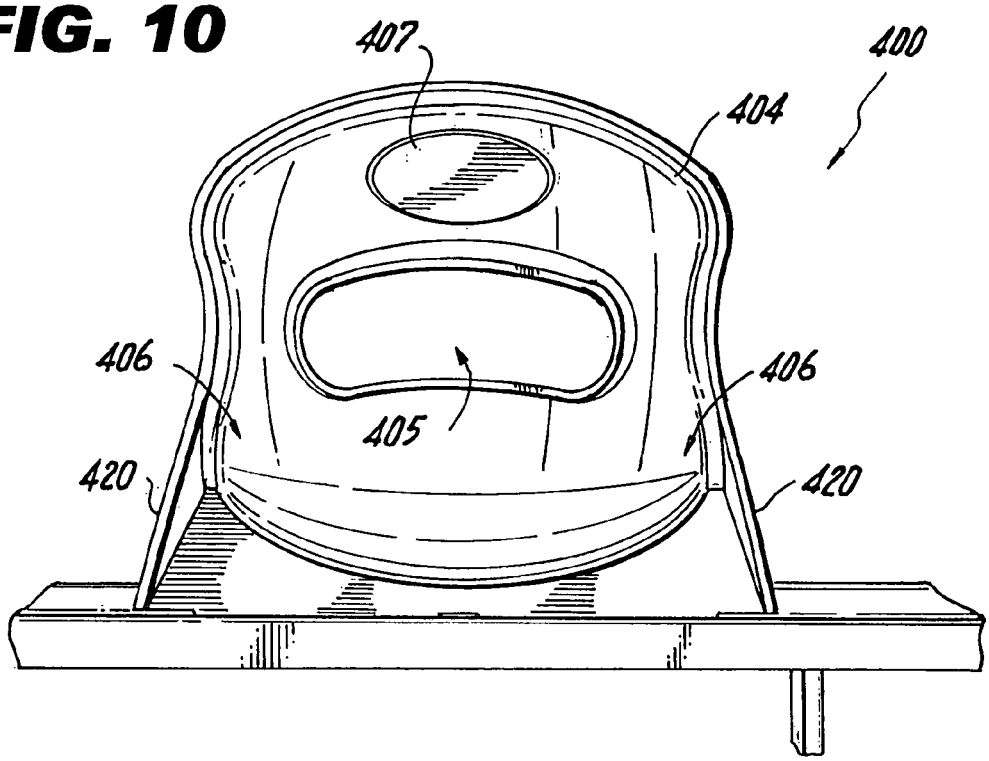
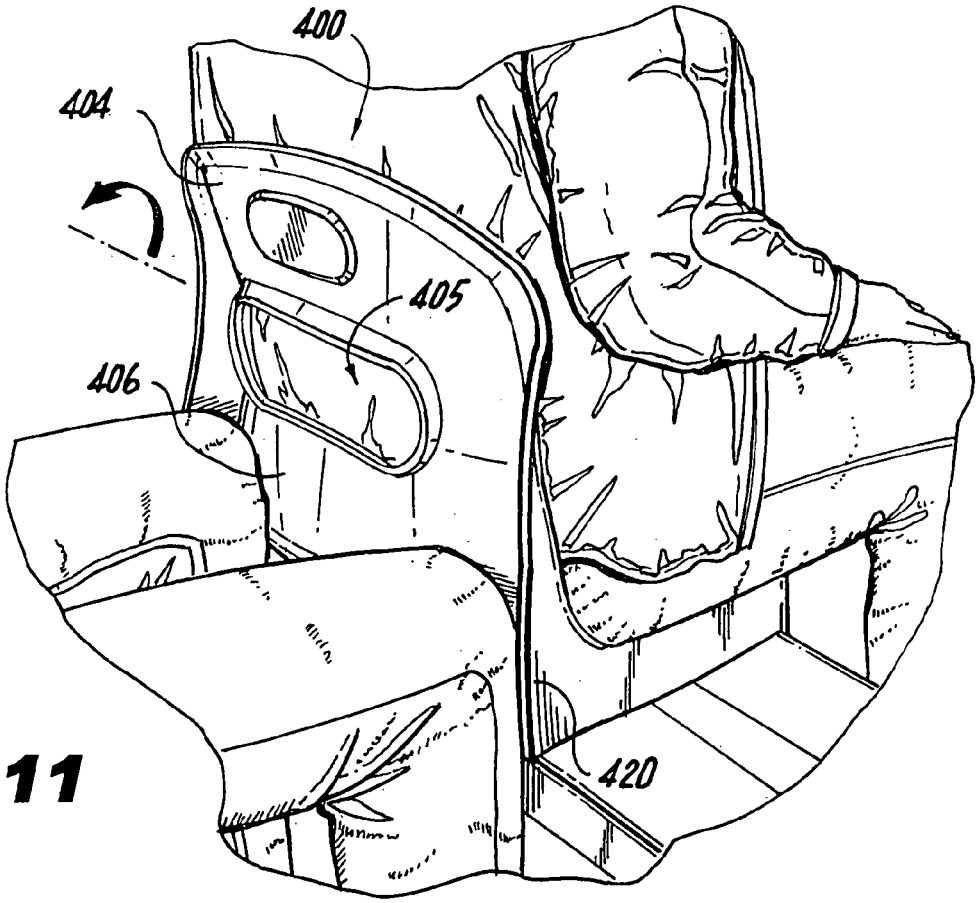
FIG. 11

FIG. 12
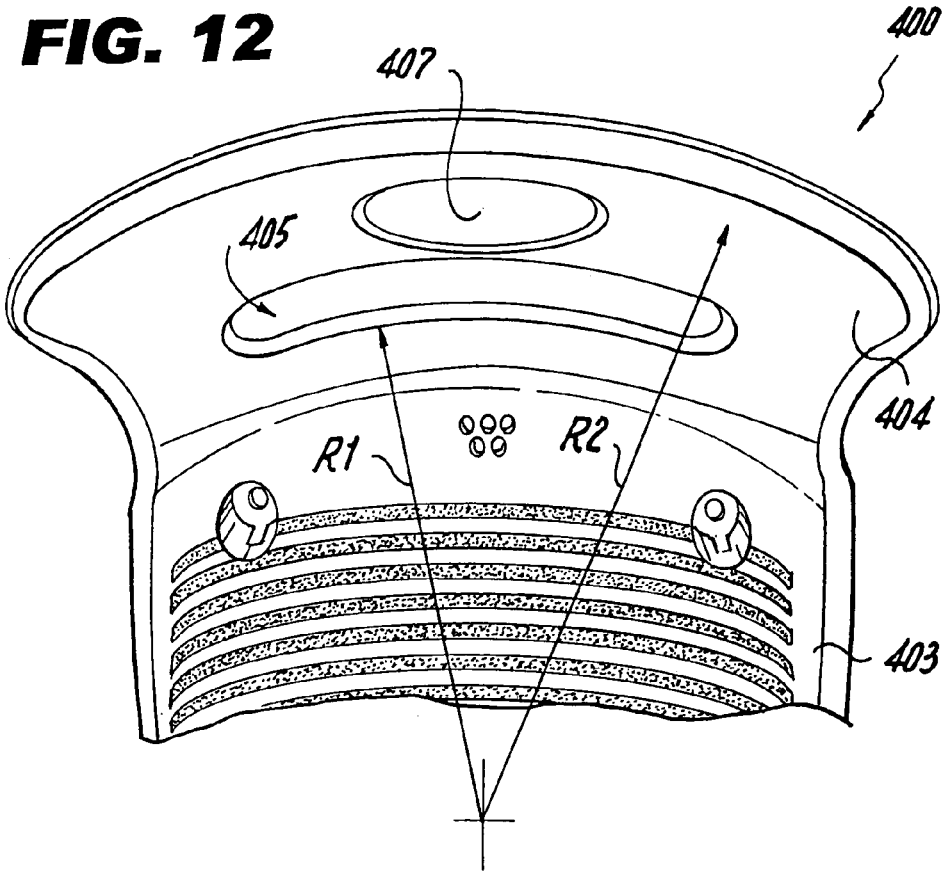
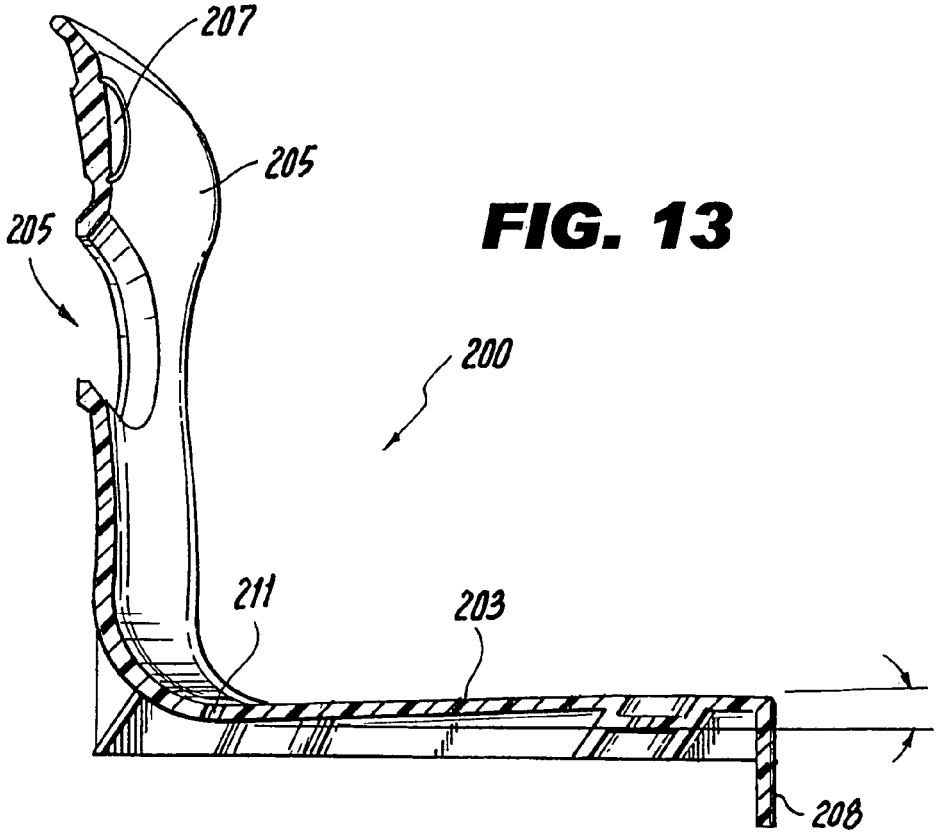
FIG. 13

BLEACHER SEAT

RELATED APPLICATIONS

This application is a continuation-in-part of earlier filed pending patent application Ser. No. 10/441,354 filed on May 20, 2003, now abandoned claims priority in part thereof under 35 USC 120, and incorporates the subject matter thereof by reference. This application also claims the benefit under 25 USC 119(e) of provisional application Ser. No. 60/623,832 filed on 29 Oct. 2004 and provisional application Ser. No. 60/627,523 filed on 12 Nov. 2004, and incorporates same by reference herein.

FIELD OF THE INVENTION

The disclosure relates to an improved stadium seat which is ergonomically designed to meet building code standards requiring minimum clearance between seats in front and behind each other.

BACKGROUND OF THE INVENTION

Sports stadiums typically have bleacher or bench seats, rather than the individual seats found in theatres. Bleachers are standardly made of long, plank-shaped metal or plastic and older bleachers were formed of long wooden planks. These bleachers typically lack upright lumbar and thoracic supports, although some may include stiff, narrow boards as makeshift upright lumbar and thoracic supports. Patrons are often expected to sit for great lengths of time during an event, and they become uncomfortable because of the strain that can result to their upper and lower back. Bleacher planks are frequently also used as spectator walkways and steps through the stadium and patrons may slip on the bleacher itself or on another patron, which can cause injuries.

Permanently affixed outdoor amphitheater seats are known in the art, however these seats are designed to have a large clearance area which poses safety and comfort issues for the using patron and the surrounding patrons.

Portable stadium bleacher seats are known in the art and may be purchased and carried into the stadium by the patrons. The portable seats are pre-formed in dimensions which may not allow the patron enough open space between the other patrons around him or allow someone to walk by that patron or his/her seat safely, thereby causing a safety hazard.

A commonly used design is a foldable seat having a seat portion and an upright lumbar and thoracic support that is foldably connected. A hook or hooks may be located on the seat portion to engage the bleacher and (loosely) secure the seat in place to the plank. However, bleacher planks are of greatly varying thickness, so clip-on seats may be impractical. The seat portion may include a single hook, or two hooks, as set forth in U.S. Pat. Nos. 2,509,420 and 3,066,980. Some problems with these designs include the size of the hook. The hook openings must properly match the thickness of the bleacher to engage it safely or the seat will shift and slip during use, causing discomfort and possible injury to the patron. Portable seats may fit the bleachers of one stadium safely but are not adjustable to engage the bleachers of additional stadium and therefore do not provide multiple use and convenience to the patrons.

In addition, many portable seats lack adequately secured upright lumbar and thoracic supports, and these upright lumbar and thoracic supports may become lose in transit, or in use, especially in a crowded stadium with the feet of other patrons directly behind the upright lumbar and thoracic support or patrons walking by the upright lumbar and thoracic support of the seat. Some designs include a hook under the seat to engage a loop on the upright lumbar and thoracic support, or to engage the upright lumbar and thoracic support itself. However, those designs typically fail to securely hold the upright lumbar and thoracic support to the seat portion of the seat.

OBJECTS OF THE INVENTION

It is therefore an advantageous object of the present invention to provide stadium seating which is both ergonomically comfortable and addresses necessary safety factors.

SUMMARY OF THE INVENTION

A bleacher seat module (Bleachair™) that contiguously forms a seat portion and an upright lumbar and thoracic support portion in one piece as a commercial grade seat, that can be retrofitted to any stadium bleacher easily to provide comfortable seating to the patrons of the stadium. The seat module conforms to building safety codes, requiring minimum clearance between seats in front and behind each other, including where 24-inch row depths are used. For example, a twelve inch clearance as measured from the back of a first bleacher seat module to the front of the seat portion of the bleacher seat module behind a first bleacher seat module, as required by the Boca National Building Code, section 1013.5.2, entitled "Row Width" and the NFPA Life Safety Code, section 8-2.7.7.2 under the heading "Aisle Accessways Serving Seating Not At Tables".

The seat is ergonomically formed and can be custom sized as desired to meet safety requirements. The bleacher seat module individually, permanently affixed is providing clearance space for traffic flow. The seat is formed to also provide additional leg/knee space for patrons seated near the bleacher seat module.

The present invention also includes a spectator bleacher seating system for sporting events includes a plurality of bleacher plank rows, with individual bleacher seats having predetermined maximum front to back depths, which provide occupant comfort while conforming to safety aisle egress codes.

Each bleacher seat of the stadium seating system includes an upright lumbar support and a forwardly extending seat sitting pan. The rows of bleacher seats are set back from each other a predetermined distance.

Each bleacher seat of the seating system has a compact front to back depth of no more than twelve inches where the distance from the front of bleacher plank to the front of the next bleacher plank is only 24 inches, or fourteen inches where the distance from the front of bleacher plank to the front of the next bleacher plank is only 26 inches. This permits the stadium to have bleacher seats in conformity with building codes requiring a minimum of twelve inch egress aisle clearance.

Despite the compact front to back depth, the bleacher seats are ergonomically comfortable to sit in at a sporting event.

Each bleacher seat of the stadium seating system is spaced apart from its respective floor panel deck by the fixed height and separated by adjacent forward or rearward bleacher seat lumbar supports by a predetermined horizontal distance, wherein the fixed height and fixed horizontal distance define a volume between each said bleacher seat and its respective floor.

Each bleacher plank of the stadium seating system has a predetermined height equal to the predetermined fixed height.

The predetermined height and predetermined horizontal distance define a defined volume that is a size that is a predetermined minimal height for patrons sitting in a row of bleacher seats and each bleacher seat lumbar support is separated from each adjacent bleacher seat lumbar support in front of or behind said bleacher seat lumbar support by the minimal horizontal distance by a horizontal distance exceeding a minimal localized volume conforming to a theoretical volume defined by a building code minimal horizontal bleacher seat separation egress clearance between said adjacent bleacher seat lumbar supports extending in a horizontal direction. The volume formed by said predetermined height and said minimal horizontal distance form a minimal localized volume conforming to a theoretical volume defined by a building code minimal separation egress distances between said adjacent bleacher seats backs.

BRIEF DESCRIPTION OF THE DRAWINGS

The present invention can best be understood in connection with the accompanying drawings. It is noted that the invention is not limited to the precise embodiments shown in drawings, in which:

FIG. 10 is a rear elevational view of the bleacher seat as in FIGS. 8 and 9, showing a flaring of the rear wall where attached to the bleacher plank;

FIG. 11 shows axis line through a kidney shaped hole in the lumbar support, allowing for flexing of the upper thoracic portion of the lumbar support while keeping the lower portion of the lumbar support less flexible and more rigid for strength of the bleacher seat and comfort of the occupant of the bleacher seat;

FIG. 11 also shows a lower knee-accommodating recess in the rear of the lumbar support of the bleacher seat, allowing for comfort of an occupant sitting behind the bleacher seat;

FIG. 12 is a partial top plan view of the bleacher seat, showing features conforming to the contour of an occupant's lumbar and thoracic regions, including a greater radius for the upper flexible portion of the thoracic region of the upright lumbar support and a smaller radius for the lower lumbar support portion of the upright lumbar support, in the region where it joins the seat pan, as well as the flaring outward of the upper rib region of the upright lumbar support, allowing for flexion thereat;

FIG. 12 also shows optional textured friction strips and water drainage holes in the forwardly extending seat pan portion of the bleacher seat;

FIG. 13 is a partial crossectional view of the bleacher seat, showing a slanted rearward descent of the forwardly extending seat pan portion of the bleacher seat; as well as one of the slanted molded hollow receptacles for one of the fasteners for mounting the bleacher seat to the plank;

FIG. 13 also shows inward taper of the kidney shaped, flexibility-inducing hole, as well as the vertical ascent of the lumbar support up to the kidney shaped hole, as well as the tapered, and forward flaring of the outer edges of the bleacher seat, together with the rearward slant of the upper edge of the bleacher seat;

DETAILED DESCRIPTION

The present disclosure relates to a seat that may be used in a stadium setting and on existing bleachers. This seat is permanent, rather than portable, and is not easily removed or shifted. As a permanently affixed seat, it discourages hazards associated with walking on bleachers or using bleacher seat planks as steps or stairs. With respect to seats in front of it, the seat is designed to have at least a twelve-inch clearance of its perimeters from front to back (or rear, as it is referred to in the industry) to allow safe and convenient use where other patrons can pass by without tripping or falling. Building safety codes require that the seat allow at least twelve inches, from front and behind it, of clearance space for rapid egress of patrons to walk between bleachers, which is imperative in a crowded stadium setting for traffic flow. The seats are permanently affixed to the bleachers to ensure that the requirements and spacing of the safety codes are met or exceeded. This seat is advantageously designed to include an effective brace opening that can be changed and locked on to different bleacher materials and thickness. The brace is covered to prevent removal of the bleacher seat module. This improvement allows gradual upgrades to be made to the stadium without losing use of the stadium or canceling events. These bleacher seats also now allow a stadium to be upgraded to provide additional safety and comfort without rebuilding entire sub-structure of the stadium. In a preferred embodiment, clearance of at least 24 inches from the front or leading edge of a first bleacher seat to the back edge or a second bleacher seat located behind the first bleacher in a row pattern, provides compliance with industry standards requiring a minimum twelve inch clearance, since the seat is up to twelve inches in depth. For seats up to fourteen inches within twenty six inch depth areas, the twelve inch minimum clearance is also provided.

These bleacher seats include ergonomically designed contoured seat portions and upright lumbar and thoracic supports, which dramatically increases comfort to the patrons. The bleacher seat also provides recesses or indentations in the upright lumbar and thoracic support of the seat to allow space and clearance room for the knees of a patron sitting behind that seat. Additionally, the seat may include a separate armrest module to be located between two adjacent seats, which may be installed at the same time as the bleacher seat module or at a later time.

The upright lumbar and thoracic support portion includes an upper display area which may exist as a space entirely through the upright lumbar and thoracic support or as an indentation. In either embodiment, the space may hold an advertisement, a commemorative plaque, and/or a seat number, and the like.

Figure 1:
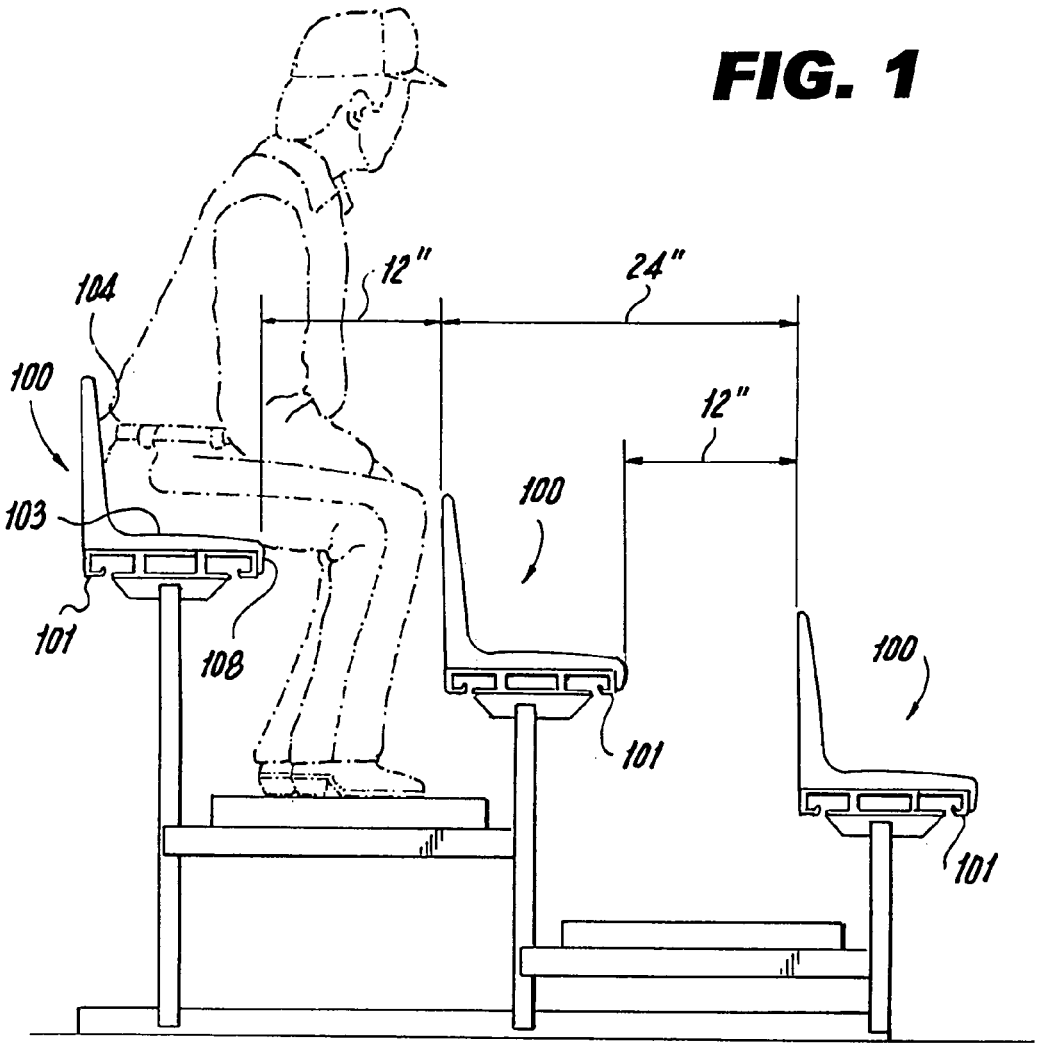
FIG. 1 is a side elevation view of a bleacher stand configuration depicting an industry aisle minimum 12 inch egress standard between seats in front of and behind each other within a 24 inch depth space region, shown with an array of a plurality of bleacher seats, according to one embodiment of the bleacher seat.
Figure 2:
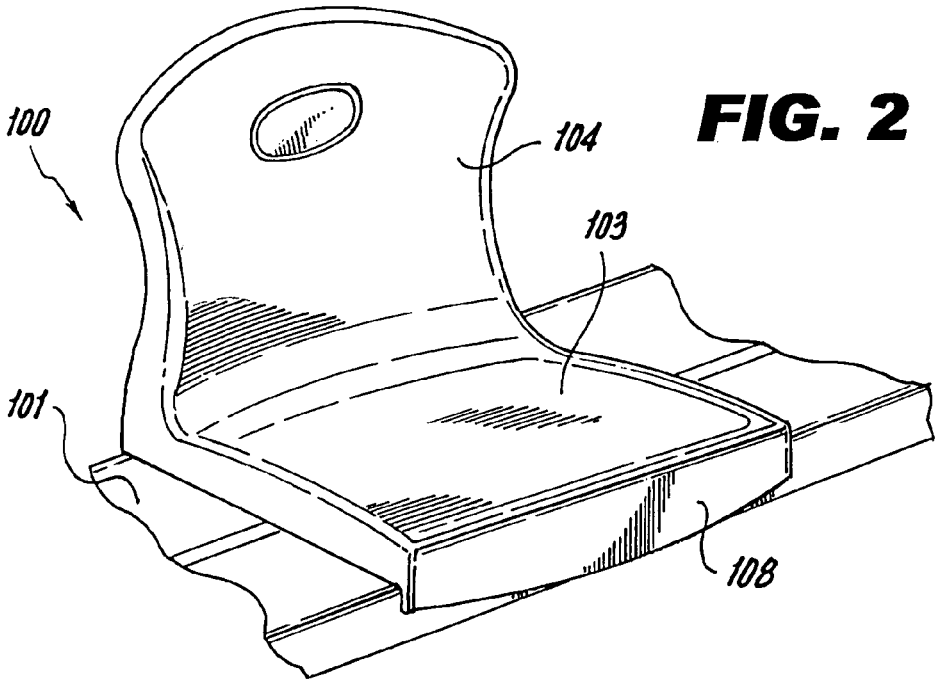
FIG. 2 is front perspective view of one embodiment for a bleacher seat of this invention with an optional front apron.
Figure 3:
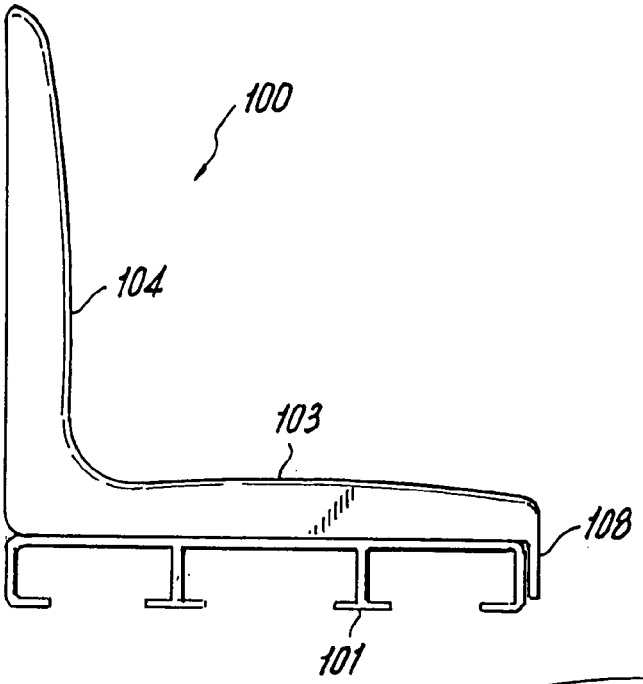
FIG. 3 is a side elevational view of the bleacher seat as in FIGS. 1 and 2.
Figure 4:
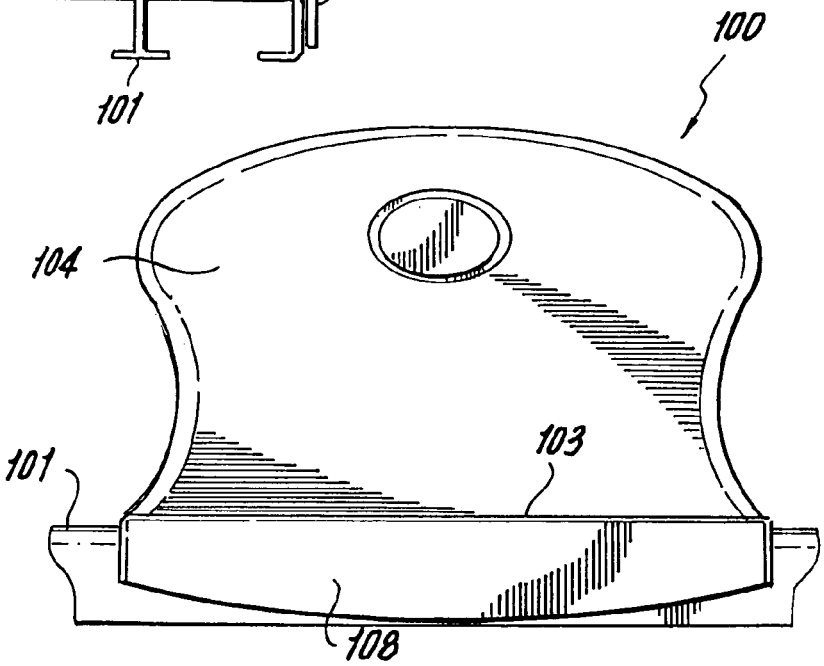
FIG. 4 is a front elevational view of the bleacher seat as in FIGS. 1, 2 and 3.
Figure 5:
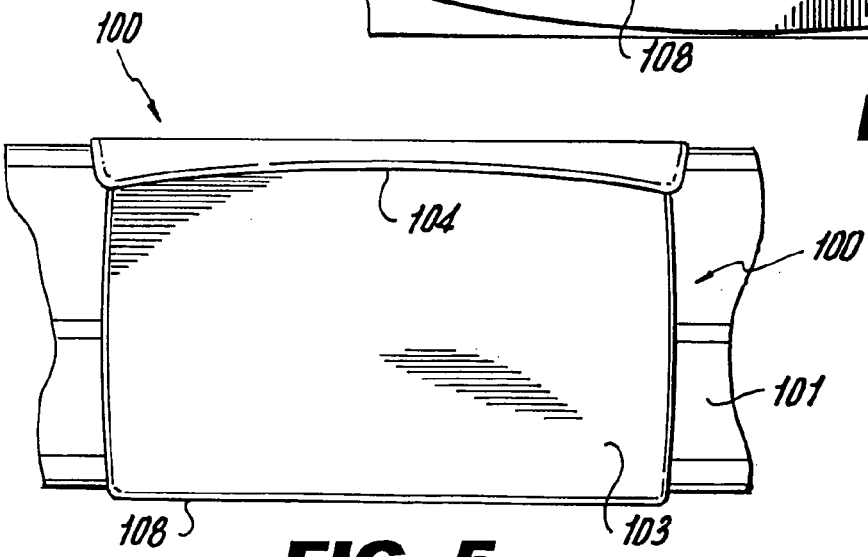
FIG. 5 is a top plan view of the bleacher seat as in FIGS. 1, 2, 3 and 4.
Figure 6:
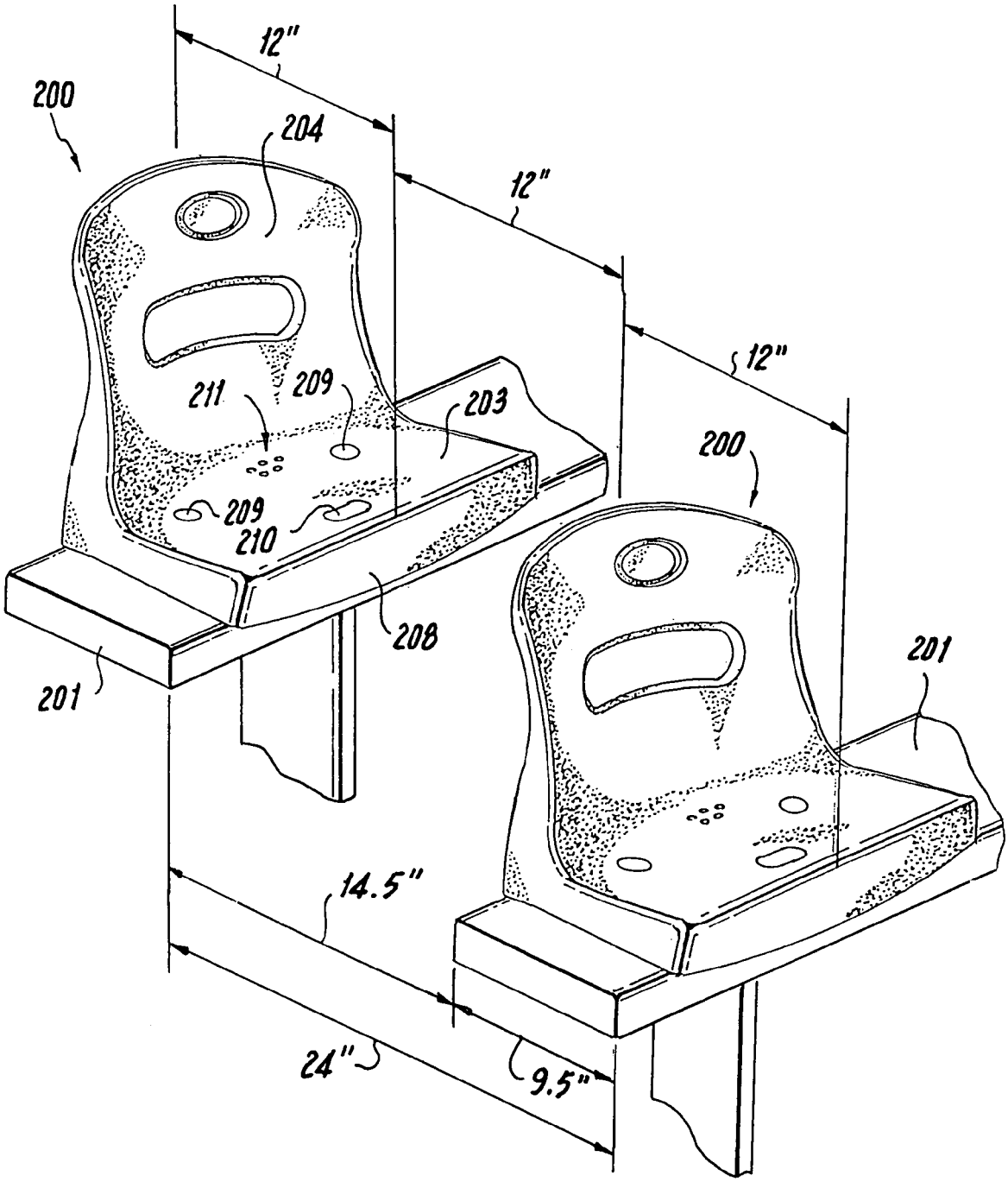
FIG. 6 is a partial close-up perspective detail view of a bleacher stand configuration depicting an industry aisle minimum 12 inch egress standard between seats in front of and behind each other within a 24 inch depth space region, shown with an array of a plurality of bleacher seats, according to a preferred 12 inch depth embodiment of the bleacher seat; shown also with the bleacher seat mounted upon a 9½ inch bleacher plank.
Figure 7:
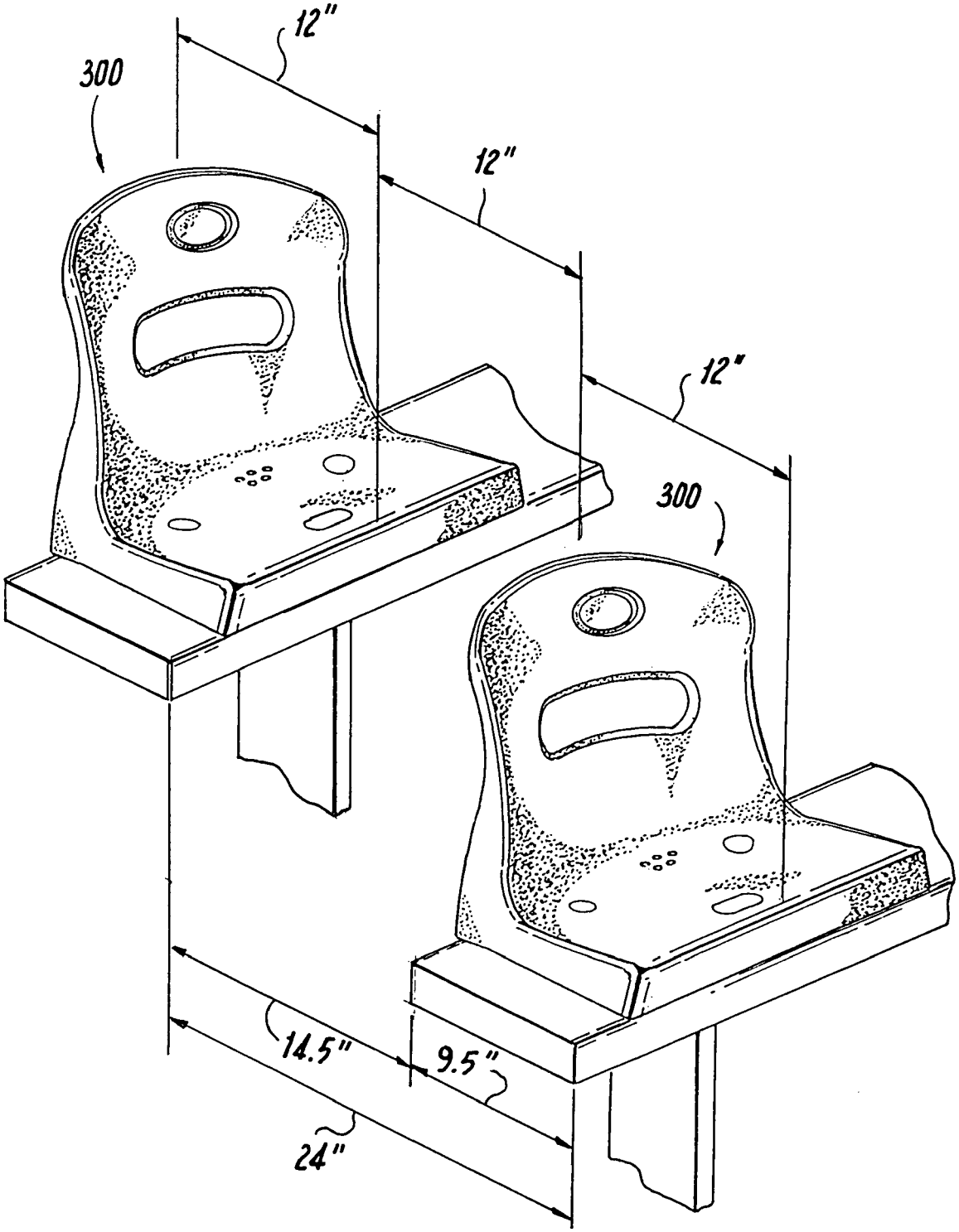
FIG. 7 is a partial close-up perspective detail view of a bleacher stand configuration depicting an industry aisle minimum 12 inch egress standard between seats in front of and behind each other within a 24 inch depth space region, shown with an array of a plurality of bleacher seats, according to a preferred 12 inch depth embodiment of the bleacher seat; shown without a front apron, shown also with the bleacher seat mounted upon a 9½ inch plank.

The preferred embodiment bleacher seat 100 of this invention is shown in FIGS. 1-5. In FIG. 1, seat includes upright lumbar support 104 and generally horizontal seat portion 103. FIG. 1 is a side elevation view of a bleacher stand configuration depicting an industry aisle minimum 12 inch egress standard between seats 100 in front of and behind each other within a 24 inch depth space region, shown with an array of a plurality of bleacher seats, mounted upon a bleacher plank 101, according to one embodiment of the bleacher seat;

The preferred embodiment bleacher seat 200 of this invention is shown in FIGS. 6-13, wherein seat 200 includes upright lumbar support 204 and generally horizontal seat portion 203.

Extended front apron 208 of seat 200 is attached to bleacher plank 201 by three fasteners 207, which are hidden by snap-in side plugs 209 and central plug 210. Also on seat 200 are shown an array of drainage holes 211 located toward the back of generally horizontal seat portion 203. The attachment to bleacher plank 201 is aided by simply pushing apron 208 against the front edge of bleacher 201 while marking the mounting holes for the fastener screws 207.

Figure 8:
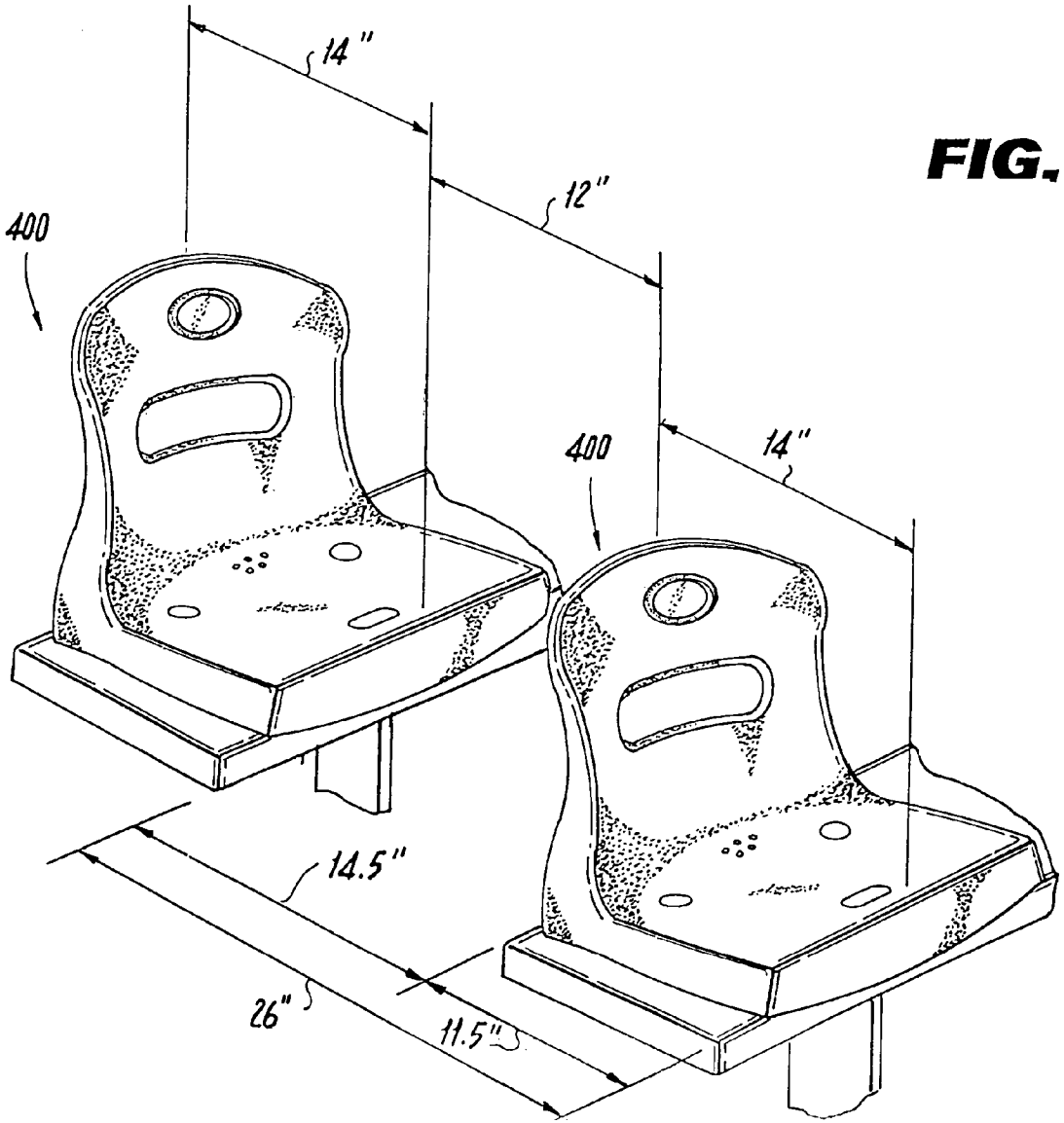
FIG. 8 is a partial close-up perspective detail view of a bleacher stand configuration depicting an industry aisle minimum 12 inch egress standard between seats in front of and behind each other within a 26 inch depth space region, shown with an array of a plurality of bleacher seats, according to an alternate 14 inch depth embodiment of the bleacher seat; shown also with the bleacher seat mounted upon an 11½ inch bleacher plank.

For some installations, a bleacher seat 300 without (see FIG. 7) an extended apron is desired. Additionally, a larger version is shown in FIG. 8 with a fourteen inch depth, for use where the clearance between seats is twenty six inches, thus permitting the minimum twelve inch egress for safety purposes.

Therefore, the preferred embodiment is available in two sizes, either up to twelve or up to fourteen inches. Depending upon clearance. It is noted that other sizes may be used within these clearances, as long as the minimum twelve inch safety egress is provided.

As shown in FIG. 13 Seat portion 203, 303 or 403 tilts downward toward the back, thereby giving under-knee support and placing the sports fan in a more natural posture.

As shown in FIGS. 10 and 11, if the person in the bleacher seat behind seat 200, 300 or 400 has his or her feet under the bleacher with knees pointing forward, side recesses 406 of upright lumbar support 404 will provide access the knees to prevent hitting upright lumbar and thoracic support 404.

Opening 405 of lumbar and thoracic support 405 is designed to provide proper flexure of lumbar thoracic support 404 for more comfortable support of the upper back while the lower contour of the lumbar thoracic support 404 provides adequate lumbar support.

Opening 405 is gently contoured in a kidney shape and framed with a rim angled toward the rear, which avoids any protruding edges which may entangle belts or other accessories.

Oval flat recess 407 is designed for attachment of logos, seat numbers, or other identifying plaque or label. The local recessed flat surface of 407, surrounded by contoured lumbar and thoracic support 404, provides a flat attachment surface while not interfering with the comfort aspects of bleacher seat 400.

The ergonomic and structural features are further illustrated in FIGS. 10 and 11. Flared gussets 420 are a structural brace feature to afford great strength in attaching upright lumbar and thoracic support 404 to seat portion 403 with minimal material. Each gusset 420 extends in a tapered fashion, with its widest portion integral with seat portion 403, and its top narrowest portion merging with the upper thoracic portion of lumbar thoracic support 404. As illustrated in FIGS. 12 and 13, the enlarged radius R2 of the upper thoracic region of lumbar thoracic support 404 as compared to the radius R1 of the lumbar portion of lumbar thoracic support 404 is an ergonomic feature to provide better fit is a small seat. For example, the smaller radius R1 more closely fits the lower lumbar region of the user. However, the larger radius R2 of the upper thoracic region allows the shoulder blades of the user to stretch naturally rearward without undue forward pressure. The larger radius R2 flattens the upper thoracic region when compared to the more concave lumbar region of lumbar thoracic support 404.

Figure 9:
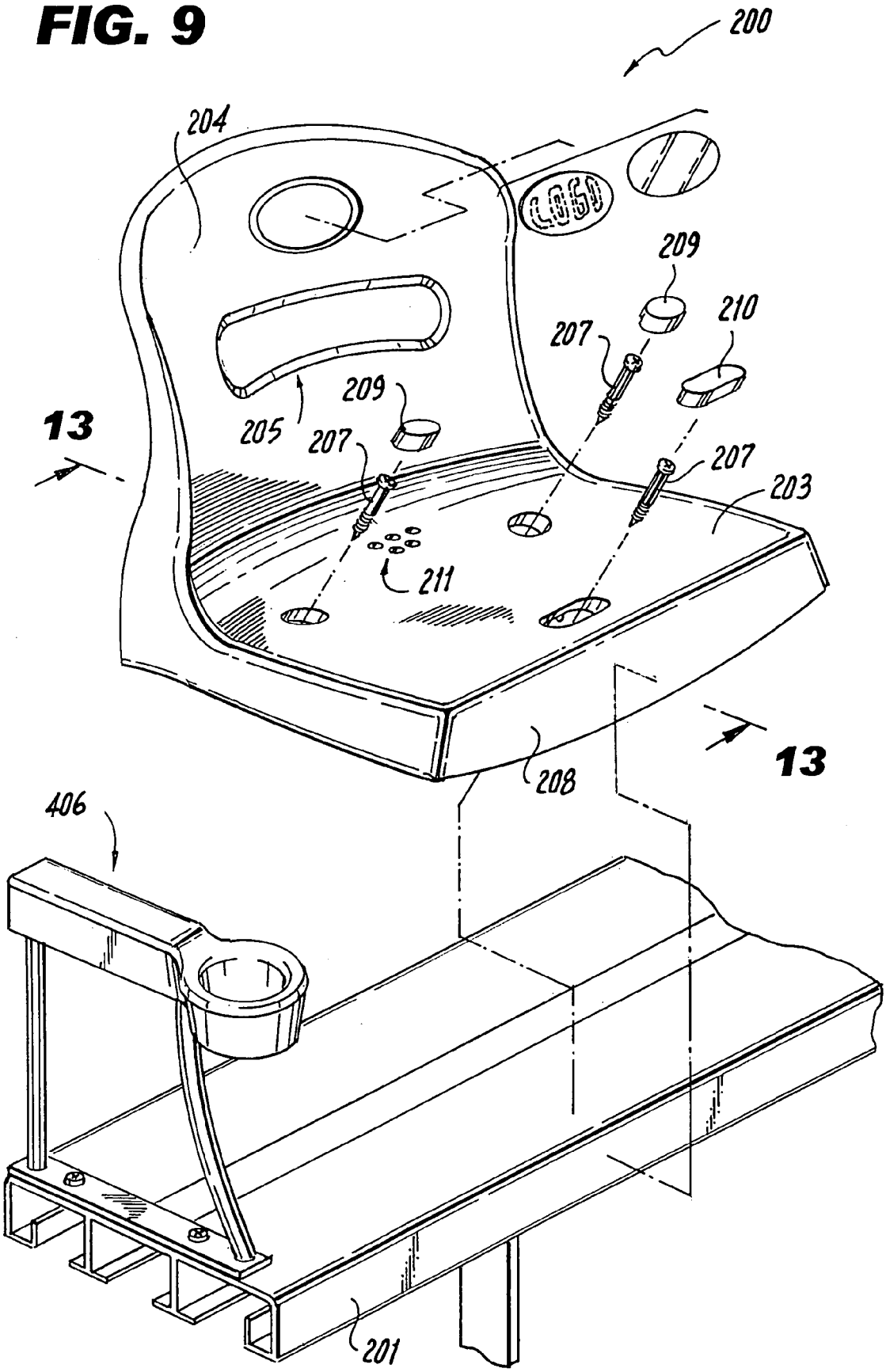
FIG. 9 is an exploded perspective view of a bleacher seat, showing mounting fasteners, identifying logo labels and optional armrest for any of the embodiments of the bleacher seat of the present invention.

FIG. 9 also shows the two side mounting recesses with mounting holes; this is with side plugs 209 and fasteners 207 removed.

The bleacher seat module 100, 200, 300, 400 may be custom formed of any durable material or composite such as a hard plastic, a thermoplastic and the like. The bleacher seat module 100, 200, 300, 400 can be formed of a fire resistant material to enhance its safety features. The material may also be highly ultraviolet (UV) resistant and stable. The seat portion 103, 203, 303, 404 and the upright lumbar and thoracic support portion 103, 203, 303, 404 are formed in a continuous one-piece bleacher seat module 100, 200, 300, 400.

The seat module 100, 200, 300, 400 may be formed by any convenient method such as molding and the like. In one embodiment, the bleacher seat module 100, 200, 300, 400 may be air-molded. In one embodiment, a thermoplastic material may be combined with a fire resistant component to form the bleacher seat module 100, 200, 300, 400. In another embodiment, the bleacher seat module 100, 200, 300, 400 may be blow molded or injection molded. In yet another embodiment, the bleacher seat module 100, 200, 300, 400 materials may also include components that impart coloration to seat designation, team logos, or decoration, UV resistance, weather resistance, and/or fire resistance. The bleacher seat module 100, 200, 300, 400 may have the form of a double wall base and a single side back design. The bleacher seat module 100, 200, 300, 400, when occupied, allows some rear tilt for comfort which will return to vertical when unoccupied to comply with egress spacing requirement. The bleacher seat module 100, 200, 300, 400 is formed in an ergonomic design to support lumbar region and promote comfort by reducing or eliminating stress and strain to the upper and lower back.

Bleacher seats 100, 200, 300, 400 are designed to meet industry egress standards. The bleacher seat modules 100, 200, 300, 400 can be custom formed to ensure that the clearance of at least twelve inches, and in a preferred embodiment the bleacher seat module allows 24 or 26 inch row spacing to comply with the industry standard, as measured from the front of the seat portion of one bleacher seat module 100, 200, 300, 400 to the back of an upright lumbar and thoracic support of another bleacher seat module 100, 200, 300, 400, to ensure that the seat module 100, 200, 300, 400 is within building safety codes of twelve inches of walking/egress/traffic flow space for seats in a row. Alternatively, the front-to-back dimensions/measurements may be referred to as depth dimensions/measurements.

The seat portion 103, 203, 303, 403 may include at least one drainage hole to allow liquid, rain, snow, refreshments and the like to quickly be removed from the bleacher seat module 100, 200, 300, 400 for the patron's comfort and cleanliness. In other embodiments, additional drainage holes or a plurality of drainage holes may be included, as desired, based on the final permanent use for the bleacher seat module 100, 200, 300, 400. The upright lumbar and thoracic support 103, 203, 303, 40 of the bleacher seat module 100, 200, 300, 400 includes a hollowed side design to allow maximum leg room to patrons surrounding seats. The ergonomic design of upright lumbar and thoracic support 100, 200, 300, 400 may include space 406 formed behind the contact surface of the upright lumbar and thoracic support 103, 203, 303, 403 for the comfort of the legs and knees of the patron sitting behind the bleacher seat module 100, 200, 300, 400. The sides of the bleacher seat module 100, 200, 300, 400 may be tapered at gussets 420 to allow additional knee/leg room for surrounding patrons as well. In general, the seat portion 103, 203, 303, 403 from front to back has less depth than the width, and is generally formed in a rectangular or oval shape, to conform with the required building safety codes for rows of seating and at least 12 inch egress in 24 or 26 inch row spacing to comply with the industry standard.

The bleacher seat module 100, 200, 300, 400 can accommodate attachment to any existing bleacher plank, whether the bleacher plank is formed of wood, metals, concrete, or the like, and regardless of thickness. The bleacher seat module 100, 200, 300, 400 includes braces 420, which may be formed as a contiguous part of the seat portion 103, 203, 303, 403, or may be fixedly attached to the seat portion in any permanent fashion, while ensuring that code requirements and measurements are met. Each bleacher seat module 100, 200, 300, 400 is its own adjustable module. Therefore, seat spacing is fully adjustable, as desired or necessary to provide safe traffic flow and egress from the stadium stands. The seating space can easily be adjusted for comfort or to increase or decrease overall seating capacity in a given row. This allows uniform placement between bleachers for safe entrance and exist of patrons walking though the clearance space between the back of a bleacher, or seats on a bleacher, and the bleacher and/or seats directly behind it.

The dimensions establish at least the minimum predetermined clearance between consecutive bleachers. The thickness dimensions of the bleacher seat modules 100, 200, 300, 400 can be included and encompassed in the clearance measurements to establish minimum predetermined clearance for safety.

The bleacher seat modules may be custom sized, when desired to ensure code clearance and industry standard, in older or unusually designed stadiums.

The upright lumbar and thoracic supports 103, 203, 303, 404 of the bleacher seat modules 100, 200, 300, 400 can include an optional oval, round, or square space 407 which exist as a space entirely through the upright lumbar and thoracic support or as an indentation. In either embodiment, the space 407 may hold an inserted advertisement, a corporate sponsorship plate, a commemorative plaque, and/or a seat number, and the like. The space 407 may also be formed in any other shape that is easily repeated by the inserted advertisement and the like, and may have holographic or lenticular images thereon.

Support components (not shown) may also be used when installing the bleacher seat module which expands and allow an increase in the bearing width of the pre-existing bleacher to securely support the bleacher seat module 100, 200, 300, 400. An armrest 406 may be added to the seat as a separate and independent module, and are formed separately of the seat module 100, 200, 300, 400. Advantageously, the armrests 406 can be purchased and installed at a later time as an upgrade to the bleacher seat module 100, 200, 300, 400, or at initial instillation. The armrest 406 can attach to the bleacher independently from the seat module 100, 200, 300, 400, which allows gradual upgrades of the stadium seating or a portion of it, as desired. The armrest 406 is designed to comply with building code egress space requirements and not interfere with traffic flow. Cup-holders may also be included in the armrest 406 module.

It will be appreciated that the disclosed bleacher seat modules 100, 200, 300, 400 are a great advantage over the art that is currently known in this area because the bleacher seat modules 100, 200, 300, 400 allow immediate and comfortable conformation with the building safety codes of twelve inch clearance and in a preferred embodiment, a 12 inch egress in a 24 or 26 inch row spacing may be used to comply with bleacher industry standard. The disclosed bleacher seat modules 100, 200, 300, 400 allow any stadium to enhance and upgrade it's seating, gradually if desired, while continuing to use the stadium to its fullest extent. The bleacher seat modules 100, 200, 300, 400 may be permanently affixed to the bleacher planks, of any material, to ensure required safety clearance spaces, unlike the portable seats of the prior art which are wide and encroach into the safety egress space as required by building codes, and also require removal and storage when not in use.

For example, in a bleacher stadium seating arrangement a plurality of backless bleacher seat planks are supported upon a plurality of stanchions. Each stanchion includes a respective vertically oriented riser portion for each backless bleacher seat and each stanchion is separated from adjacent stanchions by a horizontal support deck. Each backless bleacher seat has a minimum predetermined horizontal clearance distance between adjacent backless bleacher seats, which are positioned in front of and behind each backless backless bleacher seat. The minimum predetermined horizontal clearance distance between adjacent backless bleacher seats is sufficient for patrons of the bleacher stadium seating arrangement to have safe egress therefrom, without the risk of encroaching upon the predetermined horizontal clearance distance space in the walking space between the respective minimum predetermined horizontal clearance distance between adjacent backless bleacher seats. In a preferred embodiment, the horizontal clearance distance between adjacent backless bleacher seats may be at least 12 inches which is an industry standard.

Therefore, the respective seat portions 103, 203, 303, 403 of each bleacher seat module 100, 200, 300, 400 is contiguously formed with the upright lumbar and thoracic support portion 104, 204, 304, 404. The seat portion 103, 203, 303, 403 has at least one flared gusset brace 420 permanently affixed to the seat portion 100, 200, 300, 400 so as to provide said minimum predetermined horizontal clearance distance between adjacent bleacher seat modules 100, 200, 300, 400 in front of, and behind, each other while positioned upon the backless stadium bleacher seat planks.

Preferably each seat portion 103, 203, 303, 403 has a front to back length coterminous with a predetermined front to back length of the backless bleacher seat to which the bleacher seat module 100, 200, 300, 400 is affixed. In another embodiment, the bleacher seat module 100, 200, 300, 400 may have a front-to-back length greater than the bleacher to which it is affixed, as long as the clearance between seats in front of and in back of each other is at least twelve inches, where rows of seats are separated by 24 inches, measured from one end (front or rear) or a respective seat plank to another end (front or rear) of a seat plank in front of this respective seat plank.

The bleacher seat module 100, 200, 300, 400 with the short seat pan portion 103, 203, 303, 403 and upright lumbar and thoracic support 104, 204, 304, 404 creates a commercial grade seat that can be permanently retrofit to a plank of a bleacher bench system quickly and easily. The seat is designed so as not to interfere with required egress by building and fire safety codes, or with the 12 inch safety egress in 24 inch or 26 inch row spacing of industry standards, and afford its user the comfort of a downward slanted contoured and/or textured seat portion 103, 203, 303, 403 with an upright lumbar and thoracic support 104, 204, 304, 404.

In accordance with code minimal clearance egress space "SP" of at least twelve inches is provided between the seat bleacher seat modules 100, 200, 300, 400 when permanently affixed to bleacher seat planks (wherein the front to back distance between respective seat modules 100, 200, 300, 400 is twelve inches or greater in compliance with the codes and preferably designed to function within a 24 or 26 inch row which is the industry standard). The hollow knee accommodating regions 420 of the rear of upright lumbar and thoracic supports 104, 204, 304, 404 allows for maximum leg room. Tapered sides of each upright lumbar and thoracic supports 104, 204, 304, 404 also allow for knee room for the spectator sitting in the adjacent respective bleacher seat module 100, 200, 300, 400 behind the respective bleacher seat module 100, 200, 300, 400.

Included as an option in the bleacher seat module 100, 200, 300, 400 is hollow space 407 accommodating a pop-in sponsorship plate suitable for corporate or team ID or which is personally donated by a scholastic or collegiate sport Booster club member. The identification may optionally be holographic or lenticular to allow for multiple images on one label, depending upon the viewing angle.

The bleacher seat module 100, 200, 300, 400 has a lower support accommodating attachment of the bleacher seat module 100, 200, 300, 400 to any existing bleacher plank 101, be it wood, aluminum or concrete.

Spacing between bleacher seat modules 100, 200, 300, 400 is fully adjustable by virtue of adjusting space between the sides of adjacent bleacher seat modules 100, 200, 300, 400.

This allows uniform placement on an existing row length of the bleacher plank and in a preferred embodiment also allow controlled ticket capacity.

The optional armrest 406 is completely independent of each bleacher seat module 100, 200, 300, 400 and is capable of being purchased and installed at the same time or as an upgrade to the unit. This feature is currently not available with any other seating system. The armrest 406 attaches to substrata, such as a bleacher plank, independent of the seat module 100, 200, 300, 400. The armrest 406 is configured to comply with egress space and not interfere with traffic flow.

The bleacher seat module 100, 200, 300, 400 is preferably made as one piece and optionally includes one or more drain holes, to allow usage indoors or out without water collection. By virtue of a double wall blow molded base design and a single side upright lumbar and thoracic support 104, 204, 304, 404, the bleacher seat module 100, 200, 300, 400 when occupied, allows some rear tilt for comfort, which will return to a vertical orientation when unoccupied, thereby complying with egress spacing requirements, and in a preferred embodiment, complying with the 12 inch safety egress within a 24 or 26 inch row spacing as the industry standard.

The bleacher seat module 100, 200, 300, 400 is ergonomically designed to support lumbar region and promote comfort. By virtue of separating the ability to purchase arm rests 6 and bleacher seat modules 100, 200, 300, 400 independently, the present invention is a modular system that can be built upon year after year. Cupholders may be provided that will add to an armrest module 406.

The bleacher seating system includes a seat support expansion component that allows an increased bearing width of existing bench seats to securely support a new bleacher seat module. For example, for a 9½ inch aluminum seat plank there is supplied a 2 inch×1¾ inch aluminum angle for connection to a bench plank to support fully the new seat module 1. Similar supports may be provided for 2×10 inch wood planks, etc.

The bleacher seat module of the present invention is not a portable or retail product. It is not easily removed or brought to a game. It is permanent and complies with code. It discourages hazards associated with walking on seats. It dramatically increases comfort. It makes gradual upgrade possible without loss of use of the system in general. It allows a seating system client, for the first time, to upgrade backless bleacher seats, and preferably complying with standard 24 inch row spacing, to the comfort of a seat with an upright lumbar and thoracic support, without rebuilding the entire stadium bleacher seating arrangement sub-structure or removing any existing bleachers. Additionally, the seat modules can be easily removed or replaced, individually, as necessary.

FIG. 12 shows a bleacher seat 130 with a further optional feature of non-slip pattern of stripes 413 across seat bottom 103, 203, 303,403. These are a set of spaced apart lines approximately 0.1" wide with a molded-in matte finish which provides a higher friction surface on seat bottom 103, 203, 303, 403 than would otherwise be afforded by the glossy finish of the seat 100, 200, 300, 400.

The second further optional feature is the recessed upper seat back 104 having a top center edge 434 which is tapered and set back at the edge. It is the region above logo mounting oval 407 that is recessed (see FIG. 12). This latter ergonomic feature is more effective at accommodating the mid back portion of the anatomy; it is especially noticeable on the bleacher seat designed with a shorter depth D of seat 100, 200, 300, 400 to accommodate narrower bleacher planks, such as 9½ inch planks.

For example, embossed foil surfaces can impart an elegant image. Hologram surfaces can appear three dimensional. Multi-image holograms or "optigrams" or lenticular images can show more than one image or simulated movement when viewed at varying angles.

The embodiments of the present invention described herein are intended to illustrate but not limit the invention. While they are typical of those that might be used, other procedures known to those skilled in the art may alternatively be used.

What is claimed is:

1. A bleacher seat module comprising:

a seat portion contiguously formed with an upright lumbar and thoracic support portion, the upright lumbar and thoracic support portion having tapered sides formed by laterally flared gussets and a hollowed indentation formed between rear edges of the flared gussets and a rear surface of the upright lumbar and thoracic support portion, said seat portion and said upright portion being monolithically formed of single piece construction; said seat portion adapted to being fixedly mounted on a bleacher.

2. A bleacher seat module of claim 1, wherein the bleacher seat module is ergonomically formed.

3. A bleacher seat module of claim 2, wherein the bleacher seat module is sized to maintain clearance space between adjacent rows of bleacher seats.

4. A bleacher seat module of claim 3, wherein the seat portion has a greater width than depth to provide said clearance space.

5. A bleacher seat module of claim 4, wherein the tapered sides provide sitting space.

6. A bleacher seat module of claim 5, wherein the hollowed indentation provides sitting space.

7. The bleacher seat of claim 5 in which a recess is formed in a rear surface of said back portion for attachment of an identifying plaque or label.

8. The bleacher seat of claim 2 in which said seat portion slopes downward from a front end of said seat portion to said rear end of said seat portion.

9. A bleacher seat module of claim 1, wherein the bleacher seat module has at least one drainage hole.

10. A bleacher seat module of claim 1, wherein the upright lumbar and thoracic support portion has an indented advertisement holder.

11. A bleacher seat module of claim 1, wherein the upright lumbar and thoracic support portion has a space forming a hole as an advertisement holder or seat number.

12. A bleacher seat module of claim 1, wherein the bleacher seat module further comprises a support component.

13. A bleacher seat module comprising a seat portion monolithically formed with an upright lumbar and thoracic support portion of single piece construction, the upright lumbar and thoracic support portion having tapered sides formed by laterally flared gussets and a hollowed indentation formed between rear edges of the flared gussets and a rear surface of the upright lumbar and thoracic support portion, said seat portion having a front to back depth less than or equal to a depth of a bleacher plank to which said seat module is adapted to be fixedly attached, while providing at least a twelve inch clearance between rows of adjacent bleacher planks when aligned in at least a 24 inch row to row spacing of rows of bleacher seats.

14. A bleacher seat module of claim 13, wherein the bleacher seat module is ergonomically formed.

15. A bleacher seat module of claim 14, wherein the bleacher seat module is custom sized.

16. A bleacher seat module of claim 15, wherein the bleacher seat module is individually, fixedly attached to a bleacher plank.

17. A bleacher seat module of claim 16, wherein the seat portion has a greater width than depth to provide clearance space between adjacent bleacher seats.

18. A bleacher seat module of claim 13, wherein the bleacher seat module has at least one drainage hole formed in the seat portion.

19. A bleacher seat module of claim 13, wherein the upright lumbar and thoracic support portion has an indented advertisement holder.

20. A bleacher seat module of claim 13, wherein the upright lumbar and thoracic support has a space forming a hole as an advertisement holder or seat number.

21. A bleacher seat module of claim 16, wherein the bleacher seat module further comprises an armrest module.

22. A bleacher seat module of claim 13, wherein the bleacher seat module further comprises a brace support component.

23. A bleacher seat module for a bleacher stadium seating arrangement, wherein said bleacher stadium seating arrangement includes a minimum predetermined horizontal distance of at least 24 inches between rows of adjacent backless seat planks and having a clearance of at least twelve inches in front of and behind each said backless seat plank, said bleacher seat module comprising a seat portion monolithically formed with an upright lumbar and thoracic support portion and said seat portion in a single piece construction having tapered sides formed by flared gussets and a hollowed indentation formed between rear edges of the flared gussets and a rear surface of the upright lumbar and thoracic support portion, said seat portion having a front to back depth less than or equal to a depth of the backless seat plank to which said seat module is adapted to be fixedly attached.

24. A bleacher seat module of claim 23, wherein the bleacher seat module is ergonomically formed.

25. A bleacher seat module of claim 23, wherein the bleacher seat module is custom sized.

26. A bleacher seat module of claim 23, wherein the bleacher seat module is individually, permanently affixed to a bleacher seat.

27. A bleacher seat module of claim 23, wherein the seat portion has a greater width than depth to provide clearance space.

28. A bleacher seat module of claim 23, wherein the seat portion has at least one drainage hole.

29. A bleacher seat module of claim 23, wherein the upright lumbar and thoracic support portion has an indented advertisement holder.

30. A bleacher seat module of claim 23, wherein the upright lumbar and thoracic support portion has a space forming a hole as an advertisement holder.

31. A bleacher seat module of claim 23, wherein the bleacher seat module further comprises an armrest module.

32. A bleacher seat module of claim 23, wherein the bleacher seat module further comprises a brace support component.

33. A bleacher seat module of claim 23, wherein said seat portion has a length coterminous with a predetermined length of a backless bleacher seat.

34. The bleacher seat module as in claim 23 wherein the upright lumbar and thoracic support portion includes a hollowed indentation.

35. A bleacher seat mountable on a bench plank comprising in combination:

a bleacher bench plank;

a seat portion adapted for resting on a top surface of said bench plank;

an upright lumbar and thoracic support portion extending up from a rear end of said seat portion, said seat and upright portions being monolithically formed of one piece construction with tapered sides formed by flared gussets and a hollowed indentation formed between rear edges of the flared gussets and a rear surface of the upright lumbar and thoracic support portion;

fasteners receivable through said seat portion for fixedly attaching said bleacher seat to said bleacher bench plank;

said upright lumbar and thoracic support portion having an enlarged radius of an upper thoracic support region as compared to a smaller radius of a lower lumbar region.

36. A bleacher seat as in claim 35 further comprising said upright lumbar and thoracic support portion having indented side edges, said indented side edges providing knee access to prevent hitting seat back, said upright lumbar and thoracic support from users of a seat sitting behind.

37. The bleacher seat as in claim 35 further comprising an opening within said upright lumbar and thoracic support to provide proper flexure for more comfortable support of the upper thoracic back while the lower lumbar region provides adequate lumbar support, said opening being contoured in a kidney shape and framed with a rim angled toward the rear.

38. The bleacher seat as in claim 35 further comprising an oval flat recess for attachment of logos, seat numbers, and/or other identifying plaque or label.

39. The bleacher seat as in claim 35 further comprising a gusset brace attaching said upright lumbar and thoracic support to said seat portion.

40. The bleacher seat of claim 35 having a downwardly extending front apron for nesting against a front edge of said bench.

41. The bleacher seat of claim 35 further comprising fasteners hidden by snap-in plugs.

42. The bleacher seat of claim 35 further comprising drain holes in said seat portion.

43. The bleacher seat of claim 35 in which said upright lumbar and thoracic support portion has a narrowed waist region for accommodating knees of a person sitting on a bench behind said bleacher seat.

44. The bleacher seat of claim 35 further comprising a holographic label.

* * * * *